US009199179B2

(12) United States Patent
O'Connor

(10) Patent No.: US 9,199,179 B2
(45) Date of Patent: Dec. 1, 2015

(54) TOY PLAY SET

(75) Inventor: Stacy Lynn O'Connor, El Segundo, CA (US)

(73) Assignee: MATTEL, INC., El Segundo, CA (US)

( * ) Notice: Subject to any disclaimer, the term of this patent is extended or adjusted under 35 U.S.C. 154(b) by 419 days.

(21) Appl. No.: 13/486,492

(22) Filed: Jun. 1, 2012

(65) Prior Publication Data

US 2013/0324011 A1 Dec. 5, 2013

(51) Int. Cl.
*A63H 29/08* (2006.01)
*A63H 18/02* (2006.01)

(52) U.S. Cl.
CPC ..... *A63H 18/02* (2013.01)

(58) Field of Classification Search
CPC ..... A63H 18/02; A63H 33/12
USPC ..... 446/96, 168, 174, 444
See application file for complete search history.

(56) References Cited

U.S. PATENT DOCUMENTS

| | | | | | |
|---|---|---|---|---|---|
| 2,716,513 | A | * | 8/1955 | Braunstein | 223/94 |
| 2,917,864 | A | * | 12/1959 | Payne | 446/168 |
| 3,802,610 | A | * | 4/1974 | Love et al. | 223/94 |
| 4,108,437 | A | * | 8/1978 | DeAnda et al. | 463/59 |
| 4,114,786 | A | * | 9/1978 | Wiese | 223/94 |
| 4,186,857 | A | * | 2/1980 | Helms, Jr. | 223/94 |
| 4,291,878 | A | * | 9/1981 | Nagel et al. | 463/59 |
| 4,468,031 | A | * | 8/1984 | Barlow et al. | 273/110 |
| 4,948,019 | A | * | 8/1990 | Rodum | 223/94 |
| 5,044,534 | A | * | 9/1991 | Hwang | 223/94 |
| 5,102,126 | A | * | 4/1992 | Nguyen | 273/454 |
| 5,383,584 | A | * | 1/1995 | Adams | 223/94 |
| 5,397,037 | A | * | 3/1995 | Ozawa | 223/94 |
| 5,450,682 | A | * | 9/1995 | Franco et al. | 40/415 |
| 5,456,410 | A | * | 10/1995 | Chow | 238/10 R |
| 5,480,076 | A | * | 1/1996 | Siegel et al. | 223/94 |
| 5,967,052 | A | * | 10/1999 | Prokopf | 104/126 |
| 6,050,460 | A | * | 4/2000 | Licari et al. | 223/94 |
| 6,427,882 | B1 | * | 8/2002 | Harvey | 223/85 |
| 6,540,121 | B1 | * | 4/2003 | Harvey | 223/85 |
| 7,036,696 | B2 | * | 5/2006 | Lam | 223/94 |
| 7,241,223 | B1 | * | 7/2007 | Caudill | 463/62 |
| 7,243,823 | B2 | * | 7/2007 | Cresap et al. | 223/89 |
| 7,694,859 | B1 | * | 4/2010 | Whittaker | 223/94 |
| 7,770,811 | B2 | * | 8/2010 | Belding | 238/10 R |
| 7,828,179 | B2 | * | 11/2010 | Sprovieri | 223/94 |
| 8,177,106 | B2 | * | 5/2012 | Betts | 223/94 |
| 8,579,673 | B1 | * | 11/2013 | Monk | 446/429 |

(Continued)

FOREIGN PATENT DOCUMENTS

| | | | |
|---|---|---|---|
| CN | 2726684 | Y | 9/2005 |
| CN | 101854987 | A | 10/2010 |

OTHER PUBLICATIONS

English Translation for CN101854987 Abstract.
English Translation for CN2726684 Abstract.
First Office Action to Chinese Patent Application No. 201310216551.7 dated Jan. 20, 2015.

(Continued)

*Primary Examiner* — Melba Bumgarner
*Assistant Examiner* — Joseph B Baldori
(74) *Attorney, Agent, or Firm* — Cantor Colburn LLP

(57) ABSTRACT

A play set having a device for holding and storing track members is provided. The device includes a body and a hanger portion coupled to a first end of the body. A first arm is rotationally coupled to the body opposite the hanger portion, the first arm having a first fastener. A second arm is rotationally coupled to the body opposite the hanger portion, the second arm having a second fastener.

15 Claims, 4 Drawing Sheets

(56) References Cited

U.S. PATENT DOCUMENTS

| | | | | |
|---|---|---|---|---|
| 8,608,527 | B2 * | 12/2013 | O'Connor et al. | 446/444 |
| 2005/0242135 | A1 * | 11/2005 | Lam | 223/94 |
| 2007/0158374 | A1 * | 7/2007 | Chan | 223/85 |
| 2009/0072481 | A1 | 3/2009 | Ostendorff | |

OTHER PUBLICATIONS

English Translation of First Office Action to Chinese Patent Application No. 201310216551.7 dated Jan. 20, 2015.

* cited by examiner

TOY PLAY SET

BACKGROUND

Play sets for toy vehicles are popular toys which are known to provide entertainment and excitement to a user. These play sets typically include a track configuration intended to guide a propelled toy vehicle, such as a 1/64 scale die-cast metal toy vehicle, through a course. The track configurations include closed-loop continuous track arrangements and open-end arrangements. Toy vehicles are placed on these play set tracks and propelled across the configuration by hand or by an external propulsion means.

To bring increased entertainment and excitement to play sets, track configurations may include features such as intersecting tracks, loop segments, and other types of track configurations.

Accordingly, a play set for toy vehicles that can propel multiple toy vehicles along various track segments, which sometimes interact with each other and sometimes are placed into storage is desired.

BRIEF SUMMARY OF INVENTION

In one embodiment, a play set having a device for holding and storing track members is provided. The device includes a body and a hanger portion coupled to a first end of the body. A first arm is rotationally coupled to the body opposite the hanger portion, the first arm having a first fastener. A second arm is rotationally coupled to the body opposite the hanger portion, the second arm having a second fastener.

In another exemplary embodiment, a play set is provided. The play set includes a device comprising a body, a hanger portion coupled to one end of the body, a first arm rotationally coupled to the body opposite the hanger portion, and a second arm rotationally coupled to the body opposite the hanger portion. The first arm and the second arm are movable between a first position and a second position. The play set further includes a first track member having a first end coupled to the first arm. A second track member is provided having a second end coupled to the second arm, the first end and the second end being operably coupled when the first arm and the second arm are in the second position.

In another exemplary embodiment, a method of coupling and storing track members of a play set is provided. The method includes coupling a first track member to a first arm of a device, the first arm being rotationally coupled to a body of the device, the first track member having a first end, the device further having a hanger portion coupled to the body opposite the first arm. A second track member is coupled to a second arm of the device, the second arm being rotationally coupled to the body, the second track member having a second end. The first arm and the second arm are rotated from a first position to a second position. The first end and the second end are coupled to allow a toy vehicle to pass from the first track member to the second track member when in the second position.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Embodiments of the present invention provide for a play set and a device for a play set that facilitates the assembly and storage of the play set. The device includes features for coupling track members for use and a hanger portion that allows storage of the play set such as on a hanger rod in a closet for example. Embodiments of the present invention provide still further advantages in enhancing play by allowing the user to use the hanger to orient the track members during use such as by rotating the hanger portion to elevate the track or coupling the hanger to an external structure such as a chair for example.

Referring now to the FIGS, a play set 20 is shown having a device 22 and a plurality of track members 24, 26. The track members 24, 26 are sized to receive toy vehicles, such as but not limited to 1/64 scale die-cast metal toy vehicles for example. The device 22 provides advantages in facilitating the coupling of track members 24, 26 for use during play and also allows storage of the play set 20 on a hanger rod (not shown) when not in use.

Figure 3:
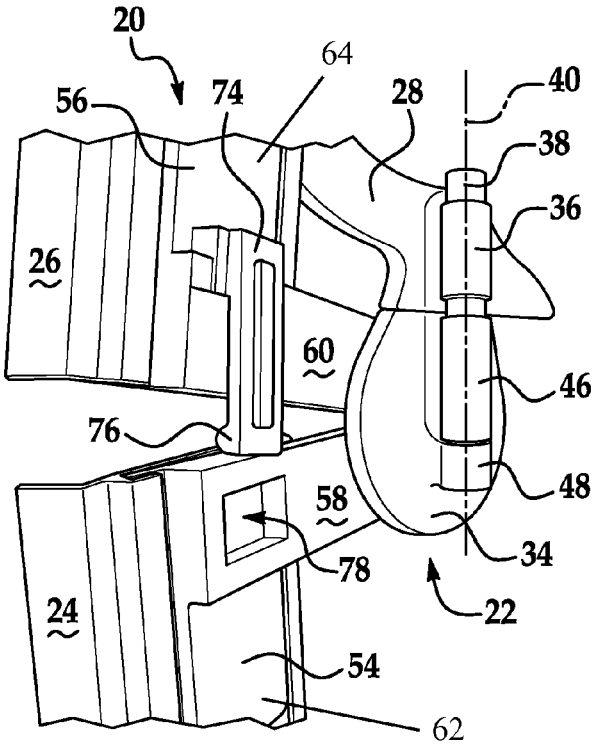
FIG. 3 is a perspective view of a play set having the device according of FIG. 1 in a third configuration.

The device 22 includes a hanger portion 28. The hanger portion 28 has a generally curved or hooked shape defining an open area 30 sized to receive the hanger rod, such as would be found in a closet for example. The hanger portion 28 is made from a suitable material appropriate for a play set, such as a plastic for example. On one end 32, the hanger portion 28 is coupled to a body 34. In one non-limiting embodiment, the hanger portion 28 includes a projection 36 (FIG. 3), such as a hollow cylinder for example. The projection 36 includes an opening sized to receive a pin 38. The pin 38 defines an axis of rotation 40 that allows the hanger portion 28 to rotate relative to the body 34. The rotation of the hanger portion 28 provides advantages in allowing the play set to be stored in a closet or other location in a variety of positions to accommodate the space that is available. In one non-limiting embodiment, the hanger portion 28 is integrated to the body 34 and does not rotate relative to the body 34.

In the exemplary embodiment, the body 34 is a generally planar member having a semicircular end 42 and a generally flat end 44. In one embodiment, the body 34 includes a projection 46 having an opening sized to receive the pin 38. The pin 38 may be coupled to the body 34 via a standoff 48 adjacent the projection 46. In one non-limiting embodiment, the pin 38 is integrally formed in the body 34. The body 34 further includes an opening 50 sized to receive a fastener 52, such as a screw or pin for example. As will be discussed in more detail below, the fastener 52 secures hanger arms 54, 56 to the body 34 and also provides a common axis of rotation for the hanger arms 54, 56. In the exemplary embodiment, the common axis formed by the fastener 52 is substantially perpendicular to the axis 40.

In the exemplary embodiment, the hanger arms 54, 56 are generally "L" shaped having a first portion 58, 60 and a generally perpendicular second portion 62, 64 respectively. In one non-limiting embodiment, the hanger arms 54, 56 are a mirror image of each other. The second portion 54, 56 includes a generally planar area 66, 68 having a projection 70, 72 thereon. As will be discussed in more detail herein, the projections 70, 72 are sized to couple with openings in the track members 24, 26 to secure the track members 24, 26 to the device 22. This configuration allows the track members 24, 26 to rotate relative to the device 22 between a first position and a second position while also allowing for the track members 24, 26 to be removed from the device 22 if desired. It should be appreciated that other means for fastening the track members 24, 26 to the hanger arms 54, 56 may also be used. For example, the track members 24, 26 may couple to the hanger arms 54, 56 by fasteners such as screws or bolts for example. In still further non-limiting embodiments, the track members 24, 26 may be coupled to the hanger arms 54, 56 by non-rotating fasteners, such as hook and loop fasteners for example.

Figure 1:
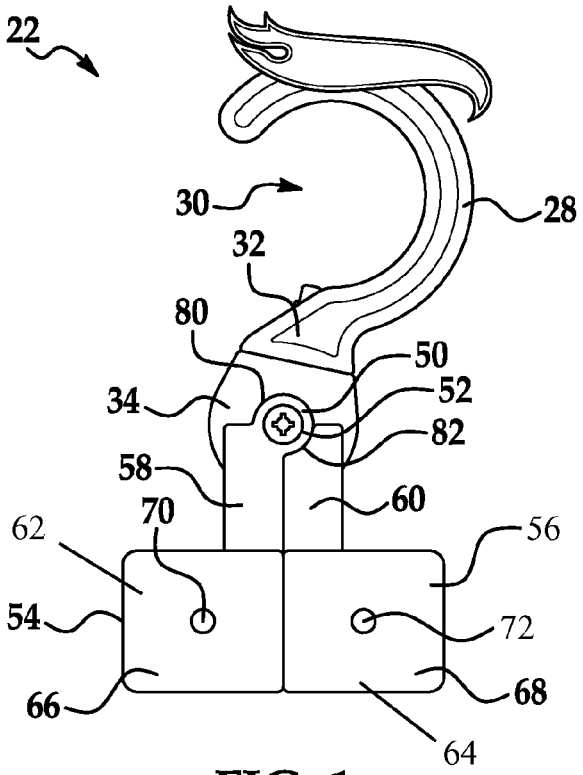
FIG. 1 is a side view of a track coupling and storage device in a first configuration according to an embodiment of the invention.
Figure 2:
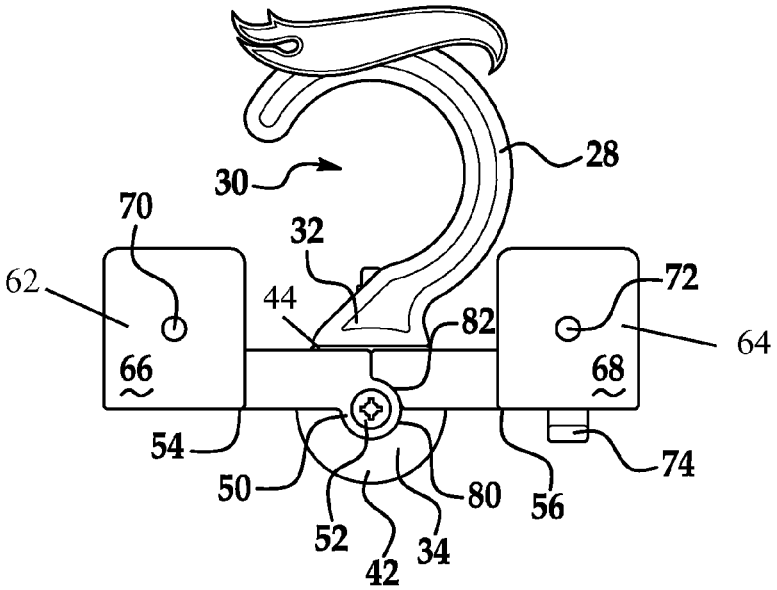
FIG. 2 is a side view of the device according of FIG. 1 in a second configuration.
Figure 4:
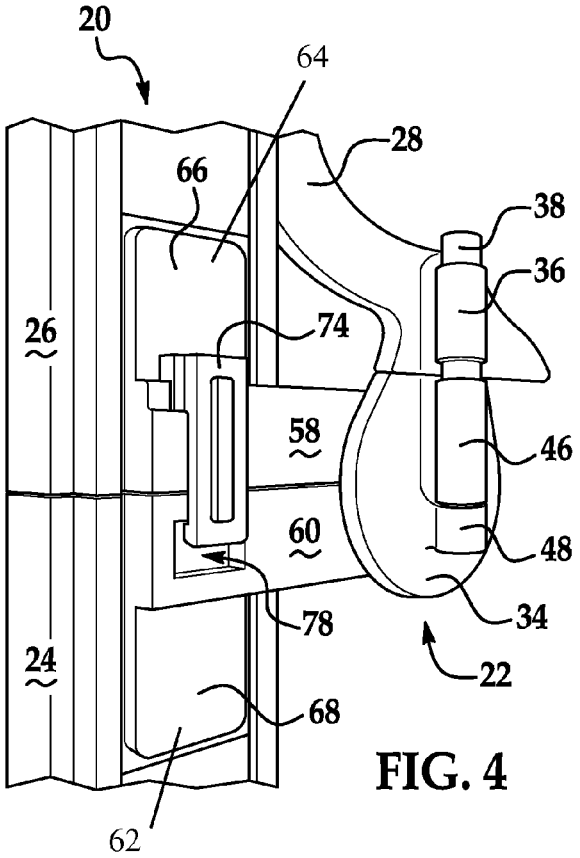
FIG. 4 is another perspective of the play set of FIG. 3 with the device according to FIG. 1 in the second configuration.

In one non-limiting embodiment, the second hanger arm 56 includes a coupling arm 74 extending from the first portion 58 adjacent an end opposite the body 34. The coupling arm 74 is cantilevered in a direction toward the first hanger arm 54 and includes a projection or a detent 76 on a distal end. The first hanger arm 54 includes a slot 78 in the first portion 58. The slot 78 is sized and positioned to engage the detent 76 (FIG. 4) when the hanger arms 54, 56 are rotated from the storage or first position (FIG. 2) to the operating or second position (FIG. 1). The coupling arm 74 and slot 78 cooperate to releasably hold the hanger arms 54, 56 in the second position during use.

In one embodiment, the first portion 58 includes a circular portion 80 and the first portion 60 includes a semi-circular recess 82 that cooperate to allow the hanger arms 54, 56 to be positioned directly in contact with each other in the second position (FIG. 1). When the device 22 is rotated to the storage or first position (FIG. 1, FIG. 6), the end 84 of the first portion 58 contacts the end 86 of first portion 60 to allow the hanger arms 54, 56 to remain aligned under the weight of the track members 24, 26 when hung in a vertical orientation, such as in a closet for example.

Figure 6:
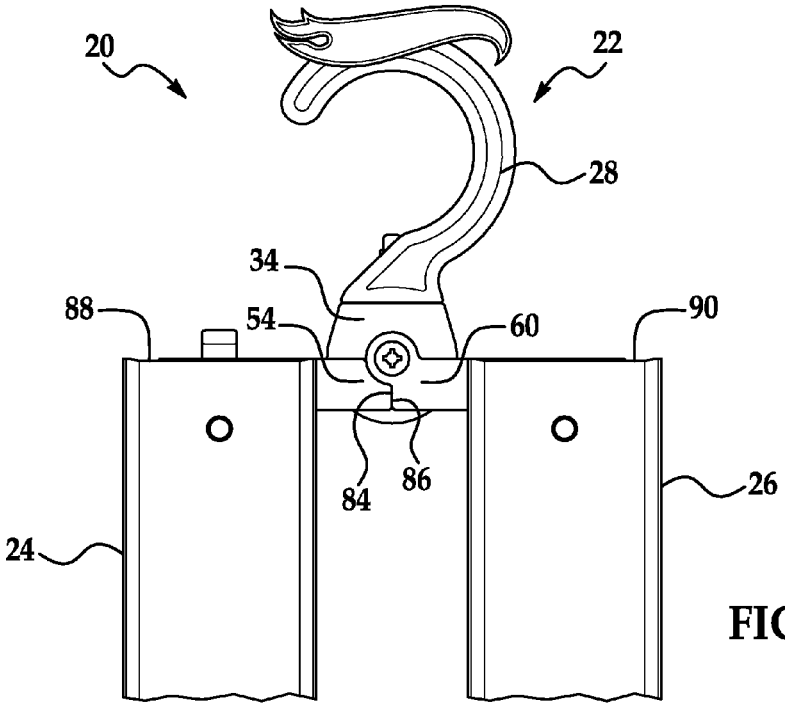
FIG. 6 is a side view of the play set of FIG. 3 with the device according to FIG. 1 is the second configuration with track members attached; and, FIG. 7 is a side view of the play set of FIG. 3 with the device according to FIG. 1 in a fourth configuration.
Figure 7:
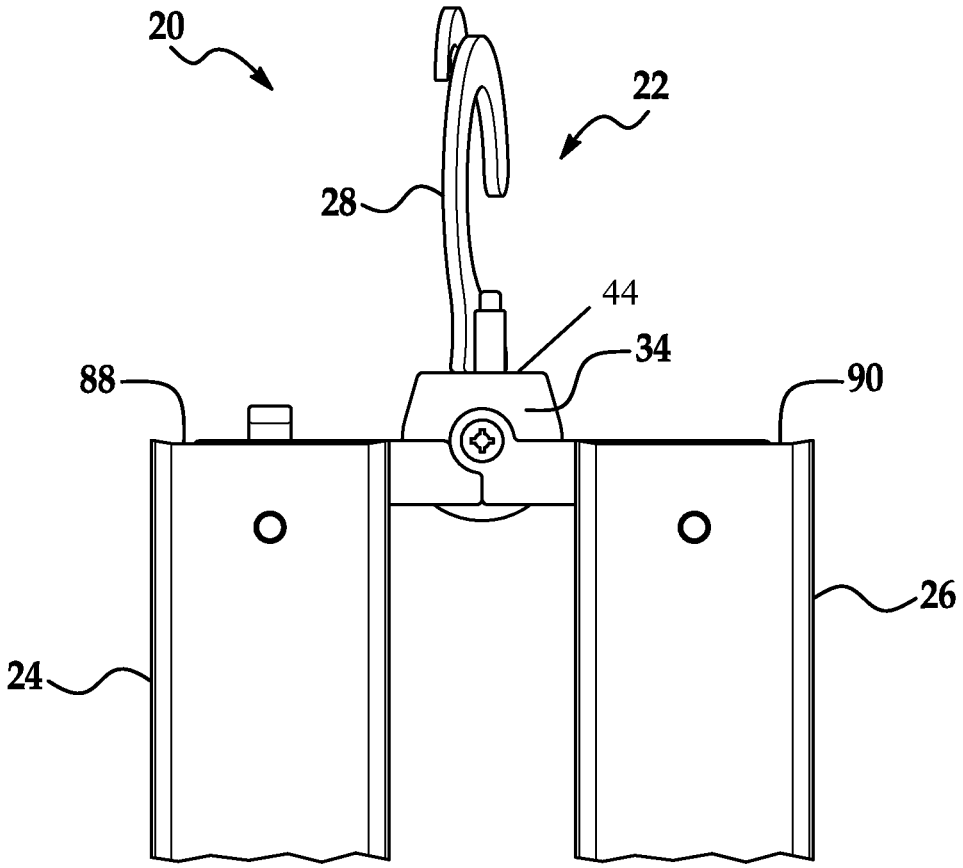

To use the device 22 with the play set 20, the user first couples the track members 24, 26 to the hanger arms 54, 56 with the device 22 in the storage or second position (FIG. 6). It should be appreciated that while FIGS. 6-7 show the track members 24, 26 as being extended in a generally parallel configuration when installed, this is for exemplary purposes, the track members 24, 26 are rotationally coupled to the projections 70, 72 and therefore may be rotated to any configuration. Further, it should be appreciated that if the device 22 is coupled to a hanger rod, the track members 24, 26 will tend to hang in a vertical orientation as shown.

Figure 5:
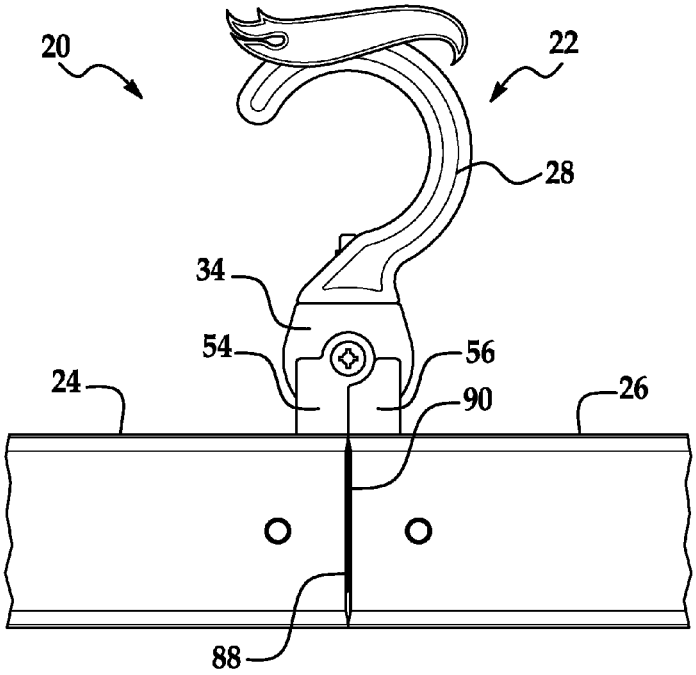
FIG. 5 is a side view of the play set of FIG. 3 with the device according to FIG. 1 in the first configuration with track members attached.

With the track members 24, 26 coupled to the device 22, the user may either hang the device in a desired storage location (e.g. a closet) or rotate the hanger arms 54, 56 from the first position to the operating or second position shown in FIG. 5. When rotated to the second position, the ends 88, 90 of the track members 24, 26 are arranged adjacent each other in an aligned configuration. It should be appreciated that in this position, the track members 24, 26 are operably coupled such that a toy vehicle on the first track member 24 may travel directly onto the second track member 26 during play. In the exemplary embodiment, as the hanger arms 54, 56 are rotated to the second position, the detent 76 on coupling arm 74 engages the slot 78 to retain the track members 24, 26 in the desired position.

In one non-limiting embodiment, the hanger portion 28 may be rotated relative to the body 34 to a position such as that shown in FIG. 7. This provides advantages allowing enhanced play since the hanger may be rotated 90 degrees relative to the plane of the hanger arms 54, 56 to elevate the ends 88, 90 of the track members 24, 26 from the play surface. Further still, the user may couple the hanger portion 28 to an external object, such as a chair cross member, a cabinet handle or other such structure to still further elevate the track members 24, 26 during play.

When play is finished, or the user desires to place the play set 20 into storage, the user rotates the hanger arms 54, 56 by decoupling the detent 76 from the slot 78 and moves the arms to the first position (FIG. 6). When arranged vertically, this provides advantages in allowing the play set 20 to be stored in compact configuration and also prevents pieces of the play set 20 from becoming separated from each other.

It should be appreciated that while embodiment illustrates track members coupled to the device 22, this is for exemplary purposes and any pair of segments in a toy track play set may be coupled to the device 22, such as but not limited to launchers, trick track elements other track portions and the like.

Embodiments of the present invention provide advantages in allowing assembly and storage of a play set. Embodiments provide advantages in allowing the play set to be hung vertically in a storage location such as in a closet on a hanger rod. Embodiments provide further advantages in keeping pieces of the play set coupled together both during play and in storage. Embodiments provide still further advantages in allowing the user to elevate the track members during play.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A play set comprising:

a device comprising a body, a hanger portion coupled to one end of the body, a first arm rotationally coupled to the body opposite the hanger portion, and a second arm rotationally coupled to the body opposite the hanger portion, the first arm and the second arm being movable between a first position and a second position;

a first track member having a first end coupled to the first arm; and, a second track member having a second end coupled to the second arm, the first end and the second end being operably coupled to each other when the first arm and the second arm are in the second position and wherein the first end and the second end are uncoupled from each other when the first arm and the second arm are in the first position and wherein the first arm has a first fastener that is engageable with an opening in a surface of the first track member to couple the first track member to the first arm; and wherein the second arm has a second fastener that is engageable with an opening in a surface of the second track member to couple the second track member to the second arm.

2. The device of claim 1 wherein the first arm and the second arm rotate about a common axis.

3. The device of claim 2 wherein the hanger portion rotates about an axis substantially perpendicular to the common axis.

4. The device of claim 1 wherein the first fastener is a first projection extending from a side of the first arm and the second fastener is a second projection extending substantially parallel to the first projection.

5. The play set of claim 1 wherein the hanger portion is rotationally coupled to the body about a first axis.

6. The play set of claim 5 wherein the first track member is rotationally coupled to the first arm and the second track member is rotationally coupled to the second arm.

7. The play set of claim 6 wherein the device further includes a coupling arm extending from the first arm and the second arm includes a slot, the coupling arm being configured to engage the slot when in the second position.

8. The play set of claim 7 wherein the first arm and the second arm rotate about a common axis.

9. The play set of claim 8 wherein the first track member rotates about a second axis and the second track member rotates about a third axis, the second axis and the third axis being substantially parallel to the common axis.

10. The play set of claim 7 wherein the first track member is oriented in a first configuration in the first position and oriented in a second configuration when in the second position.

11. The play set of claim 10 wherein the first track member has a longitudinal axis substantially parallel to the first axis when in the first configuration and substantially perpendicular to the first axis when in the second configuration.

12. The play set of claim 1 wherein the hanger portion is configured to engage a hanger rod.

13. The device of claim 1, wherein the first arm includes a planar portion that is received by the first track member and the first fastener is a projection that extends from the planar portion, and the second arm includes its own planar portion that is received by the second track member and the second fastener is a projection that extends from the second arm planar portion.

14. The device of claim 1, wherein the first arm includes a slot formed therein, and the second arm includes a coupling arm with a detent that is engageable with the slot to couple the first arm and the second arm together.

15. The device of claim 1, wherein the first arm is slidably engageable with the first track member and the second arm is slidably engageable with the second track member.

* * * * *